US008599224B2

(12) United States Patent
Yoo et al.

(10) Patent No.: US 8,599,224 B2
(45) Date of Patent: Dec. 3, 2013

(54) ORGANIC LIGHT EMITTING DISPLAY AND DRIVING METHOD THEREOF

(75) Inventors: Myoung-Hwan Yoo, Yongin (KR); Choon-Yul Oh, Yongin (KR); Oh-Kyong Kwon, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 523 days.

(21) Appl. No.: 12/872,893

(22) Filed: Aug. 31, 2010

(65) Prior Publication Data

US 2011/0205250 A1 Aug. 25, 2011

(30) Foreign Application Priority Data

Feb. 23, 2010 (KR) ..... 10-2010-0016383

(51) Int. Cl.
*G09G 5/10* (2006.01)
*G09G 5/00* (2006.01)

(52) U.S. Cl.
USPC ..... 345/690; 345/212

(58) Field of Classification Search
USPC ..... 345/76, 690, 691, 204, 211, 212
See application file for complete search history.

(56) References Cited

U.S. PATENT DOCUMENTS

| | | | | |
|---|---|---|---|---|
| 6,734,636 | B2 * | 5/2004 | Sanford et al. | 315/169.3 |
| 7,696,773 | B2 | 4/2010 | Levey | |
| 2005/0270257 | A1 * | 12/2005 | Shin | 345/76 |
| 2008/0231562 | A1 | 9/2008 | Kwon | |
| 2009/0051628 | A1 | 2/2009 | Kwon | |
| 2009/0309818 | A1 | 12/2009 | Kim | |

FOREIGN PATENT DOCUMENTS

| | | |
|---|---|---|
| JP | 2009053647 | 3/2009 |
| JP | 2009301037 | 12/2009 |
| KR | 10-2007-0038915 | 11/2007 |
| KR | 10-2008-0084730 | 9/2008 |
| KR | 10-0858615 | 9/2008 |
| KR | 1020090020190 A | 2/2009 |
| KR | 1020090129336 A | 12/2009 |

* cited by examiner

*Primary Examiner* — Michael Faragalla
(74) *Attorney, Agent, or Firm* — Robert E. Bushnell, Esq.

(57) ABSTRACT

An organic light emitting diode (OLED) display comprises: an OLED; a driving transistor for supplying driving current to the OLED; a data line for transmitting a corresponding data signal to the driving transistor; a first transistor having a first electrode connected to one electrode of the OLED and a second electrode connected to the data line; and a second transistor having a first electrode connected to the data line and a second electrode connected a gate electrode of the driving transistor, wherein the first transistor, the second transistor, and the driving transistor are turned on, a first current and a second current are respectively sunk in a path of driving current from the driving transistor to the OLED through the data line, and a threshold voltage and mobility of the driving transistor are calculated by receiving a first voltage and a second voltage applied to the gate electrode of the driving transistor corresponding to sinking of the first current and the second current through the second transistor and the data line, and the data signal transmitted to the data line is compensated.

39 Claims, 11 Drawing Sheets

ORGANIC LIGHT EMITTING DISPLAY AND DRIVING METHOD THEREOF

CLAIM OF PRIORITY

This application makes reference to, incorporates the same herein, and claims all benefits accruing under 35 U.S.C. §119 from an application earlier filed in the Korean Intellectual Property Office on Feb. 23, 2010 and there duly assigned Serial No. 10-2010-0016383.

BACKGROUND OF THE INVENTION

1. Field of the Invention

The present invention relates to an organic light emitting diode (OLED) display and a driving method thereof. More particularly, the present invention relates to an organic light emitting diode display for quickly compensating deterioration of an organic light emitting diode and displaying an image with uniform luminance irrespective of a threshold voltage and mobility of a driving transistor, and a driving method thereof.

2. Description of the Related Art

Various kinds of flat display devices that are capable of reducing detriments of cathode ray tubes (CRT), such as their heavy weight and large size, have been developed in recent years. Such flat display devices include liquid crystal displays (LCDs), field emission displays (FEDs), plasma display panels (PDPs), and organic light emitting diode (OLED) displays.

Among the above flat panel displays, the OLED display using an organic light emitting diode generating light by a recombination of electrons and holes for the display of images has a fast response speed, is driven with low power consumption, and has excellent luminous efficiency, luminance, and viewing angle such that it has been spotlighted.

Generally, the organic light emitting diode display is classified into a passive matrix organic light emitting diode (PMOLED) and an active matrix organic light emitting diode (AMOLED) according to a driving method of the organic light emitting diode.

The passive matrix uses a method in which an anode and a cathode are formed to cross each other and cathode lines and anode lines are selectively driven, and the active matrix uses a method in which a thin film transistor and a capacitor are integrated in each pixel and a voltage is maintained by a capacitor. The passive matrix type has the simple structure and a low cost, however it is difficult to realize a panel of a large size or high accuracy. In contrast, with the active matrix type it is possible to realize a panel of a large size or high accuracy, however it is difficult to technically realize the control method thereof and a comparatively high cost is required.

In an aspect of resolution, contrast, and operation speed, the current trend is toward the active matrix organic light emitting diode (AMOLED) display where respective unit pixels selectively turn on or off.

However, the luminous efficiency is decreased by deterioration of the organic light emitting diode (OLED) such that the light emitting luminance is decreased for the same current.

Also, the current flowing in the organic light emitting diode according to the same data signal is changed by non-uniformity of the threshold voltage of the driving transistor controlling the current flowing in the organic light emitting diode and a deviation of the electron mobility.

The deterioration of the organic light emitting diode results in image sticking, and the characteristic deviation of the driving transistor results in mura.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an organic light emitting diode (OLED) display for improving image quality by preventing non-uniformity and deviation of luminance caused by non-uniformity of threshold voltages of transistors of pixels of the organic light emitting diode display and deviation of electron mobility, and a driving method thereof.

The present invention has been made in another effort to provide an organic light emitting diode display for realizing desired luminance irrespective of deterioration of an organic light emitting diode in real-time and by quickly sensing deterioration of the organic light emitting diode included in pixels of the organic light emitting diode display, and a driving method thereof.

The technical objects of the present invention are not limited by the above technical objects, and other technical objects that are not mentioned will be apparently understood by a person of ordinary skill in the art from the following description.

An exemplary embodiment of the present invention provides an organic light emitting diode display comprising: an organic light emitting diode; a driving transistor for supplying driving current to the organic light emitting diode; a data line for transmitting a corresponding data signal to the driving transistor; a first transistor having a first electrode connected to one electrode of the organic light emitting diode and a second electrode connected to the data line; and a second transistor having a first electrode connected to the data line and a second electrode connected to a gate electrode of the driving transistor.

The first transistor, the second transistor, and the driving transistor are turned on, and a first current and a second current are respectively sunk in a path of a driving current from the driving transistor to the organic light emitting diode through the data line.

A threshold voltage and an electron mobility of the driving transistor are calculated by receiving a first voltage and a second voltage applied to the gate electrode of the driving transistor corresponding to sinking of the first current and the second current through the second transistor and the data line, and the data signal transmitted to the data line is compensated.

The display receives a third voltage applied to one electrode of the organic light emitting diode through the data line while supplying a predetermined third current to the organic light emitting diode by turning on the first transistor.

The display detects a deterioration degree of the organic light emitting diode according to the third voltage, and compensates a data signal transmitted to the data line in order to compensate the detected deterioration.

The organic light emitting diode display further comprises: a compensator for receiving the third voltage through the data line; and a compensator selecting switch provided between the data line and the compensator, and transmitting the third voltage to the compensator when turned on by a corresponding selection signal.

The compensator comprises a current source for supplying a third current so as to detect the third voltage.

The compensator further comprises a controller for determining a deterioration degree of the organic light emitting diode according to the third voltage, and determining a compensation amount of the data signal according to the determined deterioration degree.

The second current has a current value that is less than that of the first current.

The first current represents a current value corresponding to a high grayscale data voltage, or the first current represents a current value flowing to the organic light emitting diode when the organic light emitting diode emits light with the maximum luminance.

The second current represents a current value corresponding to the low grayscale data voltage, or the second current represents a current value that is 0.1% to 50% of the first current.

The second voltage is compensated with a compensation voltage value caused by a difference between the second voltage and a voltage value applied to a gate electrode of the driving transistor that is detected by sinking with a current value flowing to the organic light emitting diode when the organic light emitting diode emits light with the minimum luminance.

The organic light emitting diode display further comprises: a compensator for receiving the first voltage and the second voltage through the data line; and a compensator selecting switch provided between the data line and the compensator, and transmitting the first voltage or the second voltage to the compensator when turned on by a corresponding selection signal.

The compensator comprises a first current sink for sinking the first current so as to detect the first voltage, and a second current sink for sinking the second current so as to detect the second voltage.

The compensator further comprises a controller for calculating a threshold voltage and an electron mobility of the driving transistor according to the first voltage and the second voltage, and determining a compensation amount of the data signal according to the calculated threshold voltage and electron mobility of the driving transistor.

Another embodiment of the present invention provides an organic light emitting diode (OLED) display comprising: a plurality of pixels including a plurality of organic light emitting diodes and a plurality of driving transistors for supplying a driving current to the organic light emitting diodes; a plurality of data lines for transmitting corresponding data signals to the pixels; and a compensator for receiving a plurality of first voltages and a plurality of second voltages that are respectively applied to the respective gate electrodes of the driving transistors through the data lines while sinking a first current and a second current on a path of a driving current from the driving transistor to the organic light emitting diode through the data line.

The compensator calculates a threshold voltages and an electron mobility of the respective driving transistors according to the received first voltages and second voltages, and compensates the data signals that are transmitted to the pixels according to the calculated threshold voltages and electron mobility of the driving transistors.

The compensator receives driving voltages of the organic light emitting diodes through the corresponding data lines while supplying a predetermined third current to the organic light emitting diodes through the data lines, determines deterioration degrees of the organic light emitting diodes according to the received driving voltages, and compensates the data signals that are transmitted to the pixels according to the determined deterioration degrees.

The organic light emitting diode display further comprises a selector including a plurality of data selecting switches connected to the data lines and a plurality of compensator selecting switches connected to a node of a plurality of diverged lines divided from the data lines.

The compensator selecting switches are turned on by the corresponding selection signals to transmit driving voltages of the organic light emitting diodes to the compensator.

The compensator comprises a current source for supplying the predetermined third current to the organic light emitting diodes.

The compensator further comprises a controller for determining deterioration degrees of the organic light emitting diodes according to respective driving voltages of the organic light emitting diodes, and determining a compensation amount of the data signal according to the determined deterioration degree.

Yet another embodiment of the present invention provides a method for driving an organic light emitting diode (OLED) display comprising a plurality of pixels including a plurality of organic light emitting diodes and a plurality of driving transistors for supplying a driving current to organic light emitting diodes, a plurality of data lines for transmitting corresponding data signals to the pixels, and a compensator for receiving a plurality of first voltages and a plurality of second voltages that are applied to respective gate electrodes of the driving transistors through the data line while sinking a first current and a second current on a path of driving current from the driving transistor to the organic light emitting diode through the data line.

The method comprises: receiving the first voltages and the second voltages applied to the respective gate electrodes of the driving transistors through the corresponding data line, thereby sensing a voltage; calculating a threshold voltage and an electron mobility of the respective driving transistors according to the received first voltages and second voltages, thereby performing calculation; and compensating a plurality of data signals transmitted to the pixels according to the calculated threshold voltages and electron mobility of the driving transistors.

The method for driving the organic light emitting diode display further comprises: receiving driving voltages of the organic light emitting diodes while the compensator supplies a predetermined third current to the organic light emitting diodes through the data lines, thereby sensing a driving voltage; and determining deterioration degrees of the organic light emitting diodes according to the received driving voltages, and compensating the data signals transmitted to the pixels according to the determined deterioration degree, thereby performing compensation.

While the sensing of a driving voltage is performed, the predetermined third current is controlled to flow to the organic light emitting diodes included in the pixels, and first transistors of the pixels for transmitting the driving voltage of the organic light emitting diode to the corresponding data line are turned on.

While the sensing of a voltage is performed, first transistors of the pixels connected between electrodes of the organic light emitting diodes and the corresponding data lines, driving transistors of the pixels for supplying driving current to the organic light emitting diodes, and second transistors of the pixels connected between the corresponding data line and a gate electrode of the driving transistor are turned on.

The method further comprises, before the calculation, compensating the second voltage with a compensation voltage value caused by a difference between the second voltage and a voltage value applied to a gate electrode of a driving transistor detected by sinking with a current value flowing to the organic light emitting diode when the organic light emitting diode emits light with the minimum luminance.

According to an embodiment of the present invention, image quality is improved by preventing non-uniformity and deviation of luminance caused by non-uniformity of a threshold voltage of transistors of pixels and deviation of electron mobility in an organic light emitting diode (OLED) display.

Further, according to an embodiment of the present invention, a screen can be displayed with desired luminance in spite of deterioration of an organic light emitting diode (OLED) in real-time, and by quickly detecting deterioration of an organic light emitting diode included in the pixels of an organic light emitting diode display and compensating the same. In addition, desired black luminance can be obtained by overcoming the problem of quickly sensing deterioration of an organic light emitting diode and simultaneously realizing achievement of black luminance.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
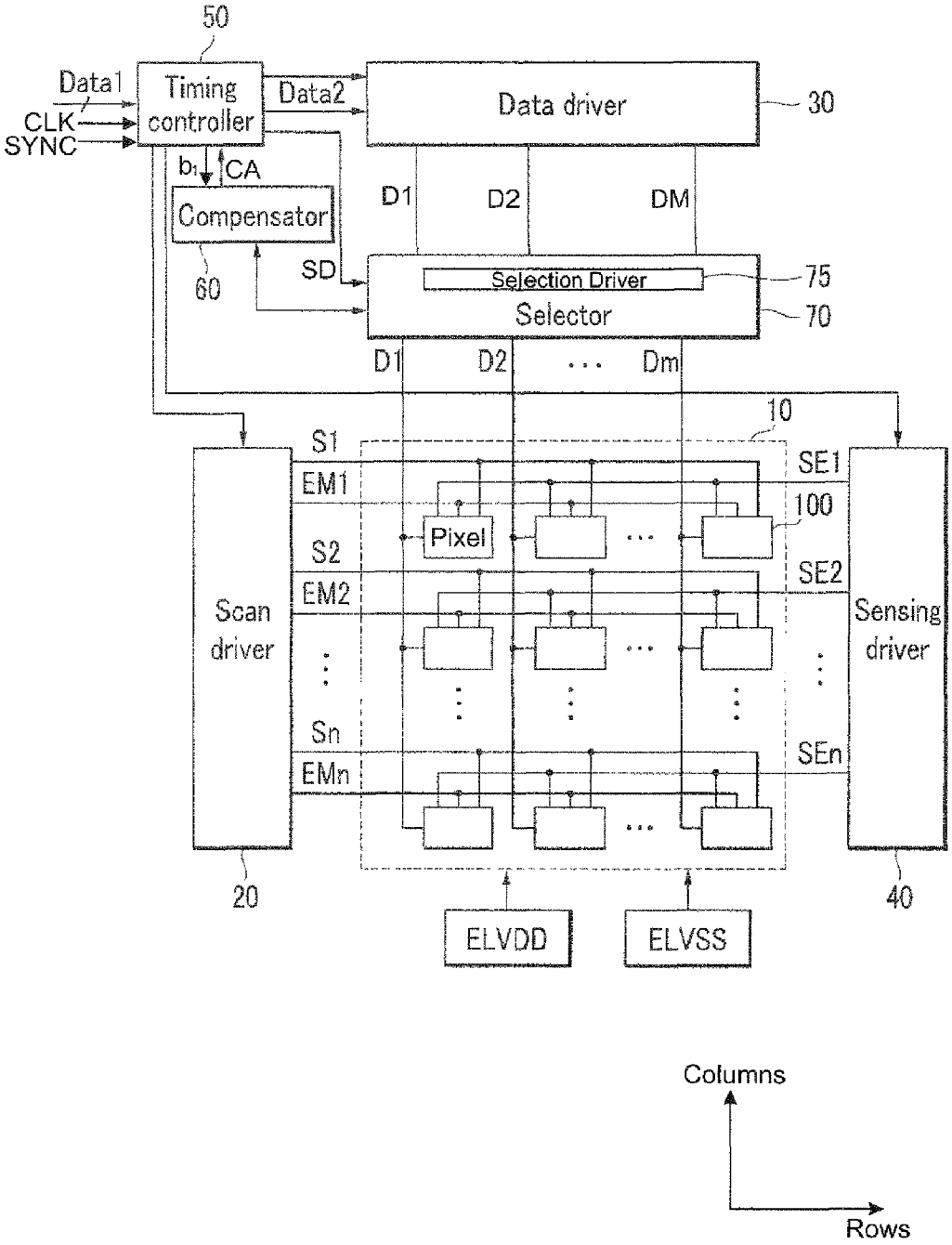
FIG. 1 is a block diagram of an organic light emitting diode (OLED) display according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Constituent elements having the same structures throughout the embodiments are denoted by the same reference numerals and are described in a first embodiment. In the other embodiments, only constituent elements other than the same constituent elements will be described.

In addition, parts not related to the description are omitted for clear description of the present invention, and like reference numerals designate like elements and similar constituent elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of an organic light emitting diode (OLED) display according to an exemplary embodiment of the present invention.

The organic light emitting diode (OLED) display includes a display 10, a scan driver 20, a data driver 30, a sensing driver 40, a timing controller 50, a compensator 60, and a selector 70.

The display 10 includes a plurality of pixels 100 arranged thereon, and each pixel 100 includes an organic light emitting diode (OLED) (refer to FIG. 3) for emitting light corresponding to a flow of driving current according to a data signal transmitted from the data driver 30.

A plurality of scan lines S1, S2, . . . , Sn formed in the row direction and transmitting scan signals, a plurality of emission control lines EM1, EM2, . . . , EMn for transmitting light emission control signals, and a plurality of sensing lines SE1, SE2, . . . , SEn for transmitting sensing signals are formed on the pixels 100. Also, a plurality of data lines D1, D2, . . . , Dm arranged in a column direction and transmitting data signals are formed on the pixels 100. The plurality of data lines D1, D2, . . . , Dm can selectively further transmit a driving voltage of the organic light emitting diode (OLED) caused by deterioration of the organic light emitting diode included in the pixel, a threshold voltage of a driving transistor, and a voltage at a gate electrode of the driving transistor for calculating mobility, in addition to the corresponding data signals.

The display 10 receives a first power source voltage ELVDD and a second power source voltage ELVSS for supplying driving current to the pixels from a power supply (not shown).

The scan driver 20 for applying the scan signals to the display 10 is connected to the scan lines S1, S2, . . . , Sn and transmits the scan signals to the corresponding scan lines.

Also, the scan driver 20 for applying the light emission control signals to the display 10 is connected to the emission control lines EM1, EM2, . . . , EMn, and transmits the light emission control signals to the corresponding emission control lines.

The scan driver 20 is described in the exemplary embodiment of the present invention to generate and transmit the light emission control signals together with the scan signals, and the present invention is not limited thereto. That is, a display device according to another exemplary embodiment of the present invention can additionally include a light emission control driver.

The sensing driver 40 for applying the sensing signals to the display 10 is connected to the sensing lines SE1, SE2, . . . , SEn, and transmits the sensing signals to the corresponding sensing lines.

The data driver 30 for transmitting the data signals to the display 10 receives the image data signals Data2 from the timing controller 50 to generate a plurality of data signals, and transmits the data signals to the corresponding data lines D1, D2, . . . , Dm in synchronization with the time when the scan signals are transmitted to the corresponding scan lines. The data signals output by the data driver 30 are transmitted to the pixels of one row to which the scan signal is transmitted among the pixels 100 of the display 10. The driving current following the corresponding data signals flows to the organic light emitting diodes (OLEDs) of the pixels.

The compensator 60 detects a driving voltage of the plurality of organic light emitting diodes (OLEDs) respectively included in the pixels, accordingly senses the deterioration (hereinafter, a deterioration degree) of the organic light emitting diodes (OLEDs), and determines a data signal compensation amount CA of compensating the sensed deterioration degree. Here, the data signal compensation amount CA is determined by the sensed deterioration degree and the data signal.

Also, the compensator 60 senses the voltages at the gate electrodes of the plurality of driving transistors included in the pixels, and respectively calculates the threshold voltage and the mobility of the driving transistors to compensate the deviation for the threshold voltage and the mobility of the driving transistors. The compensator 60 determines the data signal compensation amount CA based on the calculated threshold voltage and mobility of the driving transistors so that the organic light emitting diode (OLED) may emit light with the target luminance corresponding to the data signal, in spite of the deviation of the threshold voltage and mobility. The target luminance occurs when the current that is generated when the corresponding data signal is transmitted to the driving transistor having the threshold voltage and the mobility set as a reference flows to the organic light emitting diode (OLED).

The compensator 60 stores the data signal compensation amounts respectively corresponding to the plurality of image data signals Data2 for the respective organic light emitting diodes of the pixels. The compensator 60 transmits the data signal compensation amount CA to the timing controller 50, and the timing controller 50 adds the corresponding data signal compensation amount CA to the image data signal corresponding to the image signal to generate the compensated image data signal.

The selector 70 includes a plurality of selecting switches (not shown, referred to as data selecting switches) connected to the data lines D1, D2, . . . , Dm, a plurality of selecting switches (not shown, referred to as compensator selecting switches) for connecting a plurality of diverged lines branched from the data lines D1, D2, . . . , Dm to the compensator 60, and a selection driver 75 for generating and transmitting a plurality of selection signals for controlling the data selecting switches and the compensator selecting switches.

The data selecting switches transmit the data signals output by the data driver 30 to the plurality of data lines during the period in which the display device displays the images (hereinafter, referred to as an image display period). That is, the data selecting switches are turned on during the image display period.

The compensator selecting switches respectively connect the data lines to the compensator 60 during a period for measuring the driving voltage of the organic light emitting diode (OLED) and a period for receiving the gate voltages of the plurality of driving transistors to calculate the characteristic deviation of the threshold voltage (hereinafter, a sum of two periods will be referred to as a sensing period). The compensator selecting switches are turned off during the image display period. Also, the compensator selecting switches are sequentially turned on during the sensing period.

The selection driver 75 can receive the selection driving control signal SD from the timing controller 50 to generate a first selection signal for controlling the switching operation of the plurality of data selecting switches or a second selection signal for controlling the switching operation of the plurality of compensator selecting switches. The selector 70 corresponding to the drive timing according to an exemplary embodiment of the present invention will be described in detail with reference to FIG. 4.

Since the data selecting switches are turned on by the plurality of first selection signals during the image display period, the pixels included in a predetermined pixel row among the plurality of pixels emit light according to the driving current caused by the data signal transmitted by the corresponding data lines.

During the sensing period, the compensator selecting switches are sequentially turned on by the second selection signals. While the sensing signals are transmitted to a predetermined pixel row via sensing lines SE1, SE2, . . . , SEn, the diverged lines branched from the data lines are connected to the compensator 60 through the compensator selecting switches that are sequentially turned on. The pixels of the pixel row to which the sensing signal is transmitted are connected to the compensator 60. The above-described operation is repeated for each of the sensing lines SE1, SE2, . . . , SEn and the pixels of the corresponding pixel row. Accordingly, information on the pixels 100 to which the sensing signals are transmitted is transmitted to the compensator 60 according to the corresponding second selection signal. Here, the information on each pixel includes the driving voltage of the corresponding organic light emitting diode (OLED), the mobility, and the voltage at the gate electrode of the corresponding driving transistor.

The timing controller 50 is connected to the scan driver 20, the data driver 30, the sensing driver 40, and the selection driver 75 included in the selector 70, and receives a video (image) signal Data1, a synchronizing signal SYNC, and a clock signal CLK to generate and transmit control signals for controlling the scan driver 20, the data driver 30, the sensing driver 40, and the selection driver 75 included in the selector 70.

The timing controller 50 receives image signals Data1 (RGB image signals) including red, blue, and green, and generates image data signals Data2 by using the data signal compensation amount CA transmitted by the compensator 60.

Here, the timing controller 50 generates each image data signal by applying the threshold voltage of the corresponding driving transistor, the mobility, and the data signal compensation amounts of compensating the deviation for the driving voltage of the corresponding organic light emitting diode (OLED) to the image signal. The image data signals Data2 are transmitted to the data driver 30, and the data driver 30 transmits the data signals according to the image data signals Data2 to the pixels of the display 10. All pixels emit light by the threshold voltage of the corresponding driving transistors, the deviation of mobility, and the currents of which deviation caused by deterioration of the corresponding organic light emitting diodes (OLED) are compensated.

A partial configuration of the organic light emitting diode (OLED) display according to an exemplary embodiment of the present invention will be described in further detail with reference to FIG. 2.

Figure 2:
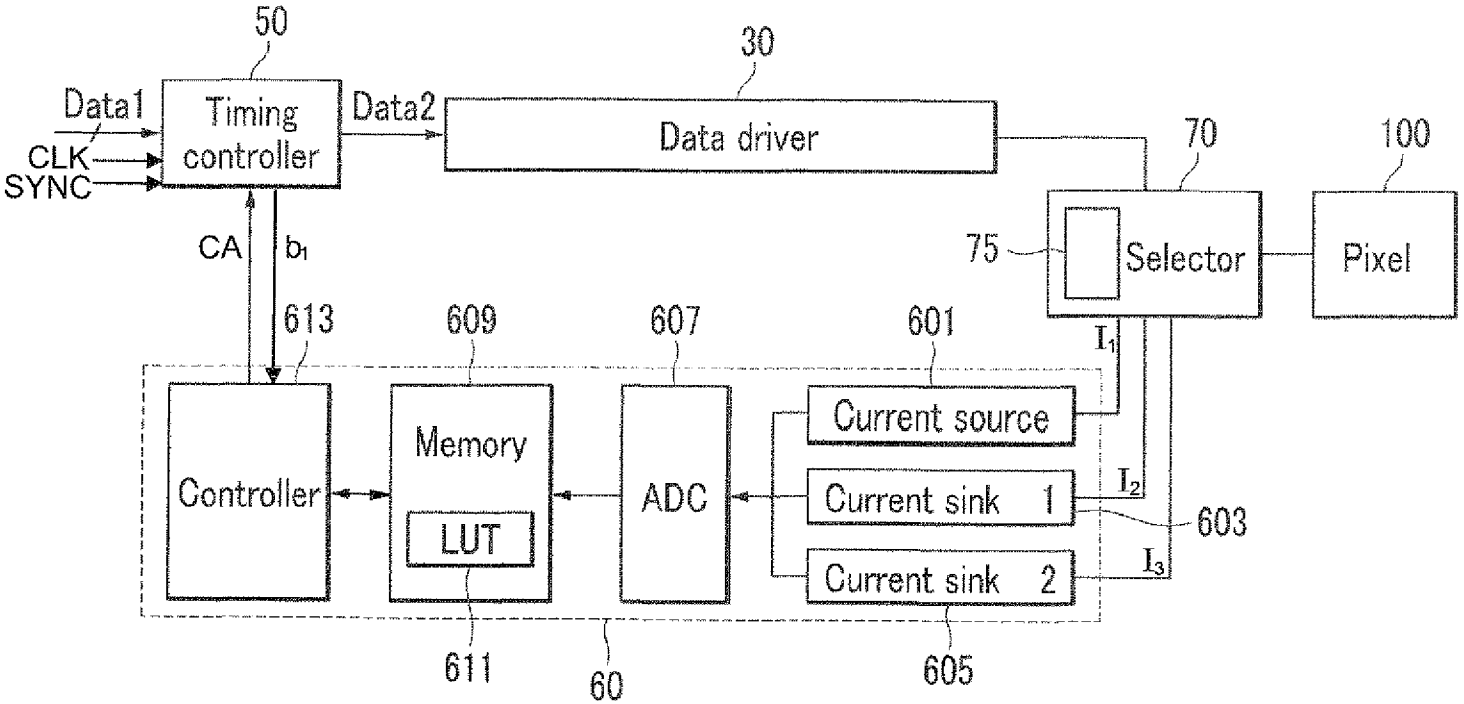
FIG. 2 is a diagram showing a detailed part of configuration shown in FIG. 1.

FIG. 2 is a diagram showing a partial configuration including the compensator from among the configuration of the organic light emitting diode (OLED) display of FIG. 1.

Referring to FIG. 2, the compensator 60 is connected to the timing controller 50 and the selector 70, and the selector 70 connects the data driver 30 to the pixel 100 and the compensator 60.

The pixel 100 shown in FIG. 2 represents one corresponding pixel from among all pixels configuring the display 10, and the compensation process and drive of the compensator 60, timing controller 50, selector 70, and the data driver 30 included in the organic light emitting diode (OLED) display according to an exemplary embodiment of the present invention are performed for all pixels of the display 10.

The compensator 60 includes a current source 601, a first current sink 603, a second current sink 605, an analog-to-digital converter (ADC) 607, a memory 609 having a lookup table 611, and a controller 613.

One current source 601, one first current sink 603, and one second current sink 605 are shown in FIG. 2, however it is not limited thereto, and more than one current source 601, first current sink 603, and second current sink 605 may be provided.

In a like manner in FIG. 2, one analog-to-digital converter 607 connected to the current source 601, the first current sink 603, and the second current sink 605 is shown, however a plurality of analog-to-digital converters 607 that are respectively connected to a plurality of current sources 601, a plurality of the first current sinks 603, and a plurality of the second current sinks 605, or are connected into a group, may be provided.

When a corresponding compensator selecting switch from among a plurality of compensator selecting switches is turned on during the sensing period, the current source 601 supplies a first current $I_1$ to the organic light emitting diode (OLED) of the corresponding pixel 100 during a period in which a switch included in the current source 601 is turned on.

A driving voltage (a first voltage) of the organic light emitting diode (OLED) of the pixel 100 is supplied to the analog-to-digital converter 607 through the corresponding data line connected to the pixel 100. Here, the first current is supplied through the organic light emitting diode (OLED) included in the pixel 100. Therefore, the first voltage supplied to the analog-to-digital converter 607 can have a voltage value having reflected deterioration of the organic light emitting diode (OLED).

In detail, as the organic light emitting diode (OLED) included in the pixel 100 is deteriorated, resistance of the organic light emitting diode (OLED) is increased, and a voltage value at an anode of the organic light emitting diode (OLED) is increased. A current value of the first current is experimentally determined so that a predetermined voltage may be applied, and when an expected voltage value of the organic light emitting diode (OLED), when the first current is supplied, is changed to a voltage value, that is, the first voltage, that is increased by deterioration of the organic light emitting diode (OLED), the change is sensed by controller 613, as will be explained later. The voltage value corresponding to a difference between the expected voltage value of the organic light emitting diode (OLED) for the first current and the voltage value of the first voltage indicates deterioration of the organic light emitting diode (OLED).

Detection of the driving voltage of the organic light emitting diode (OLED) of the pixel 100 performed by the current source 601 is performed at all pixels of the display 10 in response to turn-on of a plurality of compensator selecting switches, and respective first voltages of all pixels are transmitted to the analog-to-digital converter 607 during the sensing period.

When a corresponding compensator selecting switch from among a plurality of compensator selecting switches is turned on during the sensing period, the first current sink 603 sinks the second current $I_2$ to the corresponding pixel 100 from among a plurality of pixels while a switch included in the first current sink 603 is turned on. The second current is sunk by passing through the driving transistor included in the pixel 100. The voltage (a second voltage) at the gate electrode of the driving transistor is transmitted through a corresponding data line connected to the pixel 100 from among a plurality of data lines. A threshold voltage and mobility of the driving transistor of the pixel 100 can be calculated by using the second voltage. Detailed calculation of the threshold voltage and mobility of the driving transistor using the second voltage will be described later with reference to FIG. 4.

The current value of the second current can be set variously so that a predetermined voltage may be applied within a predetermined time, and it can be particularly set as a current value corresponding to a high grayscale data voltage. Desirably, it can be set to be a current value (Imax) that will flow to the organic light emitting diode (OLED) when the pixel 100 emits light with the maximum luminance.

Detection of the second voltage of the driving transistor of the pixel 100 performed by the first current sink 603 is performed at all pixels of the display 10 in response to turn-on of a plurality of compensator selecting switches, and respective second voltages of the entire pixels are detected and transmitted to the analog-to-digital converter 607 during the sensing period.

When a corresponding compensator selecting switch from among a plurality of compensator selecting switches is turned on during the sensing period, the second current sink 605 sinks the third current $I_3$ to the corresponding pixel 100 from among a plurality of pixels while a switch included in the second current sink 605 is turned on. The third current is sunk by passing through the driving transistor included in the pixel 100. A voltage (a third voltage) at the gate electrode of the driving transistor is transmitted to the analog-to-digital converter 607 through a data line connected to the pixel 100 from among a plurality of data lines. In a like manner, the threshold voltage and mobility of the driving transistor of the pixel 100 can be calculated by using the third voltage.

Here, the third current $I_3$ is set to be less than the second current $I_2$. Particularly, the third current can be set to correspond to the low grayscale data voltage.

In the exemplary embodiment, the third current may be determined as a current value of 0.1% to 50% of the second current.

In another exemplary embodiment, the third current can be a current that corresponds to ¼ of the current value (Imax) that will flow to the organic light emitting diode (OLED) when the pixel 100 emits light with the maximum luminance.

In the exemplary embodiment, the third voltage of the pixel 100 that is sensed when the current is sunk by the third current sink can be compensated by using the difference with the voltage value of the gate electrode of the driving transistor of the pixel that is detected when sunk with the current value corresponding to the minimum grayscale data voltage, and can be used to calculate the threshold voltage and the mobility of the driving transistor, in order to overcome the drawback that is generated when the current is sunk with a current as low as the current value corresponding to the minimum grayscale data voltage and to maintain the merit.

That is, when the current is sunk with the current value corresponding to the minimum grayscale data voltage, the time for charging the voltage at the gate electrode of the driving transistor of the pixel 100 into the corresponding data line is relatively long, and hence it is difficult to quickly sense the voltage in real-time. When the current is sunk with a low current value, it is difficult to realize it in a hardwired manner and generate it without deviation. However, when it is sunk with the current value corresponding to the grayscale data voltage, black luminance of a desired level can be acquired and the low grayscale data are easily realized.

Therefore, the organic light emitting diode (OLED) display sets the third current with a current value that is greater than the current value corresponding to the minimum grayscale data voltage, and senses the third voltage within a short time to easily compensate data in real-time. However, it accordingly becomes difficult to achieve black luminance, which is compensated by finding a compensated voltage value caused by a difference with the third voltage based on the voltage of the driving transistor that is sensed when the current is sunk by the current value that corresponds to the minimum grayscale data voltage.

Detection of the third voltage of the driving transistor of the pixel 100 performed by the second current sink 605 is detected at all pixels of the display 10 in response to turn-on of a plurality of compensator selecting switches, and the third voltages of the entire pixels are detected and transmitted to the analog-to-digital converter 607 during the sensing period.

During the sensing period, the second voltage and the third voltage sensed from each of a plurality of pixels are used to find threshold voltages and electron mobility of the driving transistors included in a plurality of pixels.

The analog-to-digital converter 607 converts the first voltage, the second voltage, and the third voltage that are respectively sensed from the entire pixels of the display 10 and respectively supplied from the current source 601, the first current sink 603, and the second current sink 605 into digital values.

Also, referring to FIG. 2, the compensator 60 includes a memory 609 and a controller 613.

The memory 609 stores the digital values of the first voltage, the second voltage, and the third voltages transmitted by the analog-to-digital converter 607.

The controller 613 calculates the threshold voltages and the mobility deviation of the driving transistors and the deterioration degree of the plurality of organic light emitting diodes (OLED) by using the digital information on the first voltage, the second voltage, and the third voltage sensed for the pixels. The memory 609 stores the calculated threshold voltages and mobility deviation of the driving transistors and deterioration degrees of the organic light emitting diodes (OLEDs).

As described, the memory 609 stores the threshold voltages and the mobility deviation of the driving transistors of the pixels, and the deterioration degrees of the organic light emitting diodes (OLEDs) per pixel.

The controller 613 calculates a data signal compensation amount CA of compensating the image data signals Data2 according to the calculated threshold voltage and the mobility of the driving transistors, and the deterioration degrees of the organic light emitting diodes (OLEDs). The memory 609 can store the data signal compensation amount as a lookup table 611. Here, the lookup table 611 stores the data signal compensation amount of compensating the image data signals Data2, the calculated threshold voltage and the mobility of the driving transistor, and the deterioration degree deviation of the organic light emitting diode (OLED), or it can store an expression for calculating the data signal compensation amount.

The timing controller 50 transmits the image data signal Data1 of a predetermined bit $b_1$ for representing the grayscale of an arbitrary pixel in the video signal to the controller 613. The controller 613 detects the information on the threshold voltage of the driving transistor, the mobility deviation, and the deterioration of the organic light emitting diode (OLED) from the memory 609, and reads the data signal compensation amount CA for compensating the image data signal transmitted according to the detected deviation and deterioration degree from the lookup table 611.

The controller 613 transmits the data signal compensation amount CA to the timing controller 50, and the timing controller 50 adds the data signal compensation amount CA to the image data signal Data1 to generate a corrected image data signal Data2 and transmit it to the data driver 30.

In detail, the image data signal Data1 can be the digital signal in which 8-bit digital signals representing the grayscale of one pixel are continuously arranged. The timing controller 50 can add the data signal compensation amount CA corresponding to the 8-bit digital signal to generate a digital signal of different bits, for example a 10-bit digital signal. The corrected image data signal Data2 becomes the signal in which the 10-bit digital signal is continuously arranged.

Upon receiving the corrected image data signal Data2, the data driver 30 uses the same to generate the data signal, and supplies the generated data signal to the pixels 100 of the display 10. The image sticking is compensated and the factor for the mura phenomenon is removed from the pixels, thereby displaying the image in uniform luminance.

Figure 3:
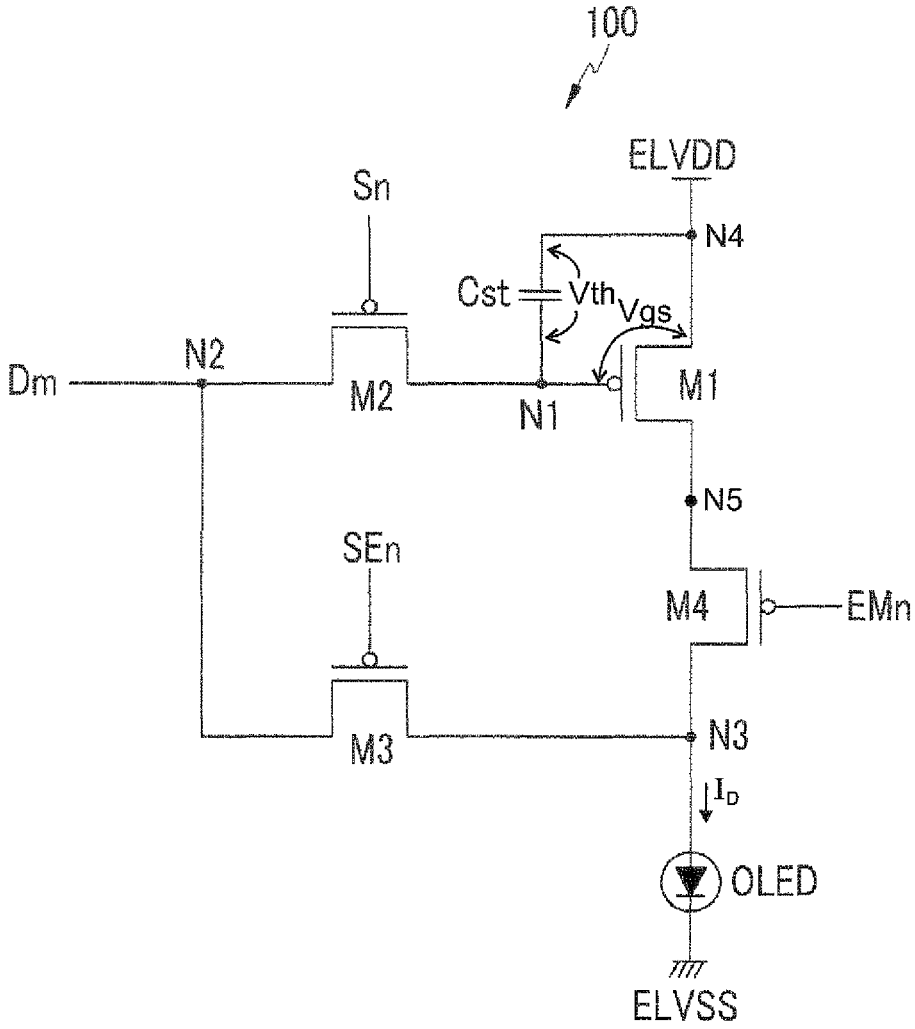
FIG. 3 is a circuit diagram of a pixel shown in FIG. 1 according to an exemplary embodiment of the present invention.

FIG. 3 is a circuit diagram of a pixel shown in FIG. 1 according to an exemplary embodiment.

FIG. 3 is a circuit diagram of a pixel 100 at a position that corresponds to an n-th pixel row and an m-th pixel column from among a plurality of pixels included in the display 10 shown in FIG. 1.

The pixel 100 includes an organic light emitting diode (OLED), a driving transistor M1, a first transistor M3, a second transistor M2, a third transistor M4, and a storage capacitor Cst.

The pixel 100 includes an organic light emitting diode (OLED) for emitting light according to a driving current $I_D$ applied to the anode, the driving transistor M1 transmitting the driving current $I_D$ to the organic light emitting diode (OLED).

The driving transistor M, provided between the anode of the organic light emitting diode (OLED) and the first power source voltage ELVDD, controls current flowing from the first power source voltage ELVDD to the second power source voltage ELVSS through the organic light emitting diode (OLED).

In detail, a gate of the driving transistor M1 is connected at node N1 to a first end of the storage capacitor Cst, and a first electrode thereof is connected at node N4 to a second end of the storage capacitor Cst and the first power source voltage ELVDD. The driving transistor M1 controls the driving current $I_D$ flowing to the organic light emitting diode (OLED) from the first power source voltage ELVDD corresponding to the voltage value according to the data signal stored in the storage capacitor Cst. In this instance, the organic light emitting diode (OLED) emits light corresponding to the driving current supplied by the driving transistor M1.

The first transistor M3, provided between nodes N3 and N2, i.e., the anode of the organic light emitting diode (OLED) and a data line Dm, respectively, receives a driving voltage of the organic light emitting diode (OLED) from the organic light emitting diode (OLED).

In detail, a gate of the first transistor M3 is connected to the sensing line SEn connected to the pixel 100, the first electrode is connected at node N1 to the anode of the organic light emitting diode (OLED), and the second electrode is connected at node N2 to the data line Dm. The first transistor M3 is turned on when the sensing signal of a gate on voltage level is supplied to the sensing line SEn, and it is turned off in other cases. The sensing signal is supplied during the sensing period.

The second transistor M2 is connected to the scan line Sn connected to the pixel 100 and the data line Dm connected to the pixel 100, and transmits the data signal of data line Dm to the driving transistor M1 in response to the scan signal transmitted by the scan line Sn.

In detail, a gate of the second transistor M2 is connected to the scan line Sn, the first electrode is connected at node N2 to the corresponding data line Dm, and the second electrode is connected at node N1 to the gate of the driving transistor M1. The second transistor M2 is turned on when the scan signal of a gate on voltage level is supplied to the scan line Sn, and it is turned off in other cases. The scan signal has an on voltage level when the voltage at the gate electrode of the driving transistor M1 is sensed in the compensator 60 from among the sensing period and when a predetermined data signal is transmitted from the data line Dm.

The third transistor M4 is provided between the anode of the organic light emitting diode (OLED) and the driving transistor M1. A gate electrode of third transistor M4 is connected to the emission control line EMn connected to the pixel 100, and controls light emission of the organic light emitting diode (OLED) in response to the light emission control signal transmitted by the emission control line EMn.

In detail, a gate electrode of the third transistor M4 is connected to the corresponding emission control line EMn, a first electrode thereof is connected at node N5 to the second electrode of the driving transistor M1, and a second electrode thereof is connected at node N3 to the anode of the organic light emitting diode (OLED). The third transistor M4 is turned on when a light emission control signal of a gate on voltage level is supplied to the emission control line EMn, and it is turned off in other cases.

The storage capacitor Cst has a first end connected at node N1 to the gate electrode of the driving transistor M1 and a second end connected at node N4 to the first electrode of the driving transistor M1 and the first power source voltage ELVDD.

A voltage $V_{th}$ corresponding to the threshold voltage of the driving transistor M1 is charged in the storage capacitor Cst, and when the data signal is transmitted from the data line Dm, a voltage at first node N1 where the first end of the storage capacitor Cst and the gate electrode of the driving transistor meet is changed corresponding to the data signal. When the driving transistor M1 and the third transistor M4 are turned on to form a current path from the first power source voltage ELVDD to the cathode of the organic light emitting diode (OLED), the current corresponding to the voltage that corresponds to the difference between the voltage value Vgs of the driving transistor M1, that is, the voltage of the data signal that is applied to the gate electrode of the driving transistor M1 and the power source voltage ELVDD at the first electrode is applied to the organic light emitting diode (OLED), and the organic light emitting diode (OLED) emits light corresponding to the applied current.

Figure 4:
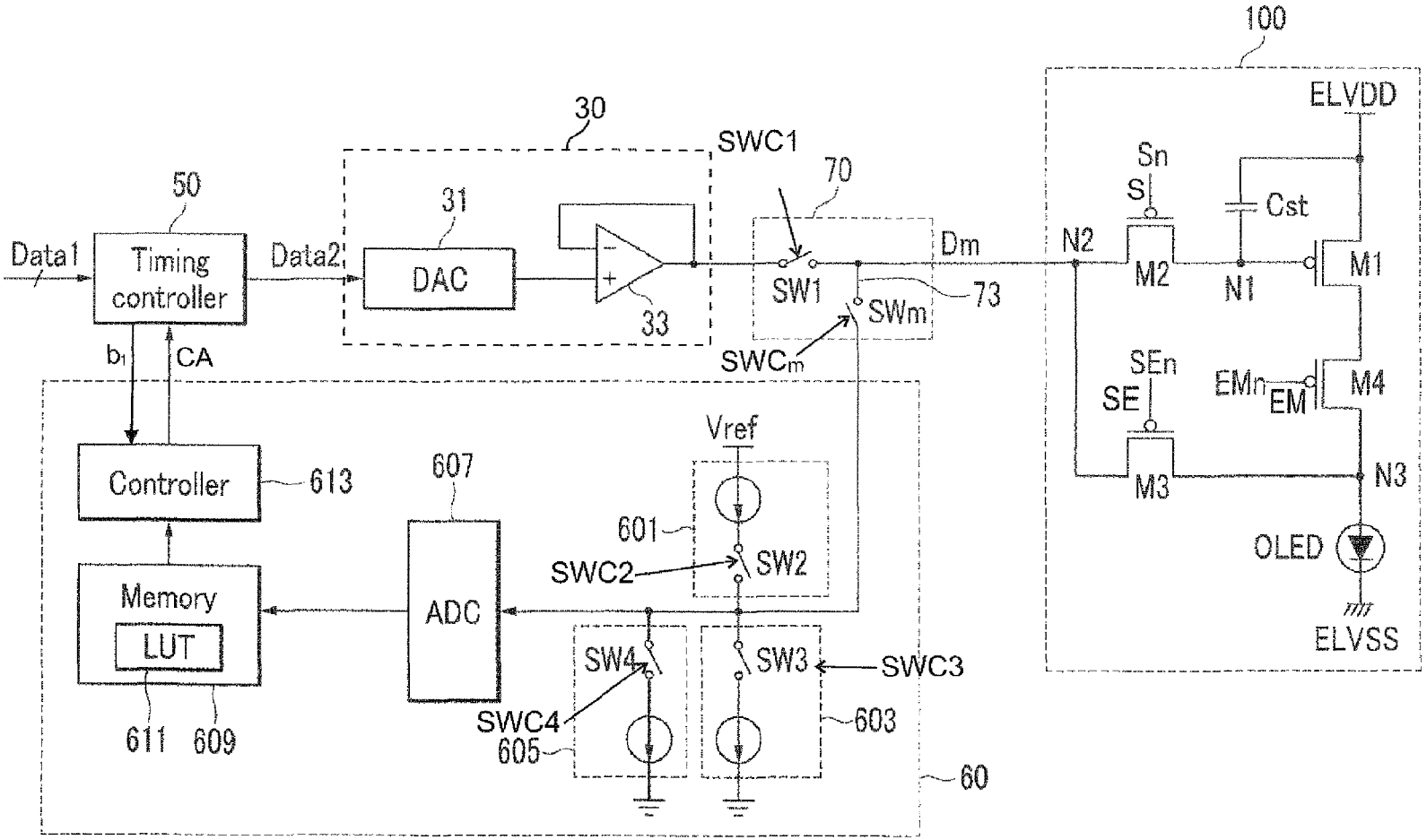
FIG. 4 is a circuit diagram of a more detailed part of a configuration shown in FIG. 2 according to an exemplary embodiment of the present invention.

FIG. 4 is a circuit diagram of a more detailed part of a configuration shown in FIG. 2 according to an exemplary embodiment of the present invention.

In detail, FIG. 4 shows a connection of a more detailed configuration of the current source 601 and the current sinks 603 and 605 of the compensator 60 of FIG. 2; a detailed configuration of a portion of the selector 70 of FIG. 1; and the circuit diagram of the pixel 100 of FIG. 3. The pixel 100 of FIG. 4 represents one corresponding pixel from among all pixels configuring the display 10, and the compensation process and driving by the compensator 60, the timing controller 50, the selector 70, and the data driver included in the organic light emitting diode (OLED) display according to an exemplary embodiment of the present invention are performed for all pixels of the display 10.

A process for compensating image sticking and mura phenomenon in an organic light emitting diode (OLED) display by using waveform diagrams of FIG. 5 to FIG. 9 together with FIG. 4 according to an exemplary embodiment of the present invention will now be described.

FIG. 4 shows a data selecting switch SW1 and compensator selecting switch SWm connected to the data line Dm connected to the pixel 100 from among a plurality of data selecting switches and a plurality of compensator selecting switches of the selector 70.

The compensator selecting switch SWm is connected to a diverged line branched from the data line Dm connected to the pixel 100. In this instance, the diverged line branched from the data line represents a compensation line 73.

When the compensator selecting switch SWm is turned on during the sensing period, the pixel 100 is sensed through the compensation line 73 and the data line Dm by the compensator selecting switch SWm. The current source 601, the first current sink 603, and the second current sink 605 of the compensator 60 are connected to the compensation line 73 connected to the corresponding data line Dm.

The current source 601 includes a first switch SW2, and is controlled by the switching operation of the first switch SW2. The first current sink 603 includes a second switch SW3, and is controlled by the second switch SW3. Also, the second current sink 605 includes a third switch SW4, and is controlled by the third switch SW4. The selection signals for controlling the switching operations of the first switch SW2, the second switch SW3, and the third switch SW4 can be generated and transmitted by the timing controller 50 or by the selection driver 75 of the selector 70.

The first switch SW2, the second switch SW3, and the third switch SW4 can be commonly connected to one node, and the voltage at the node is transmitted to the analog-to-digital converter 607.

Figure 5:
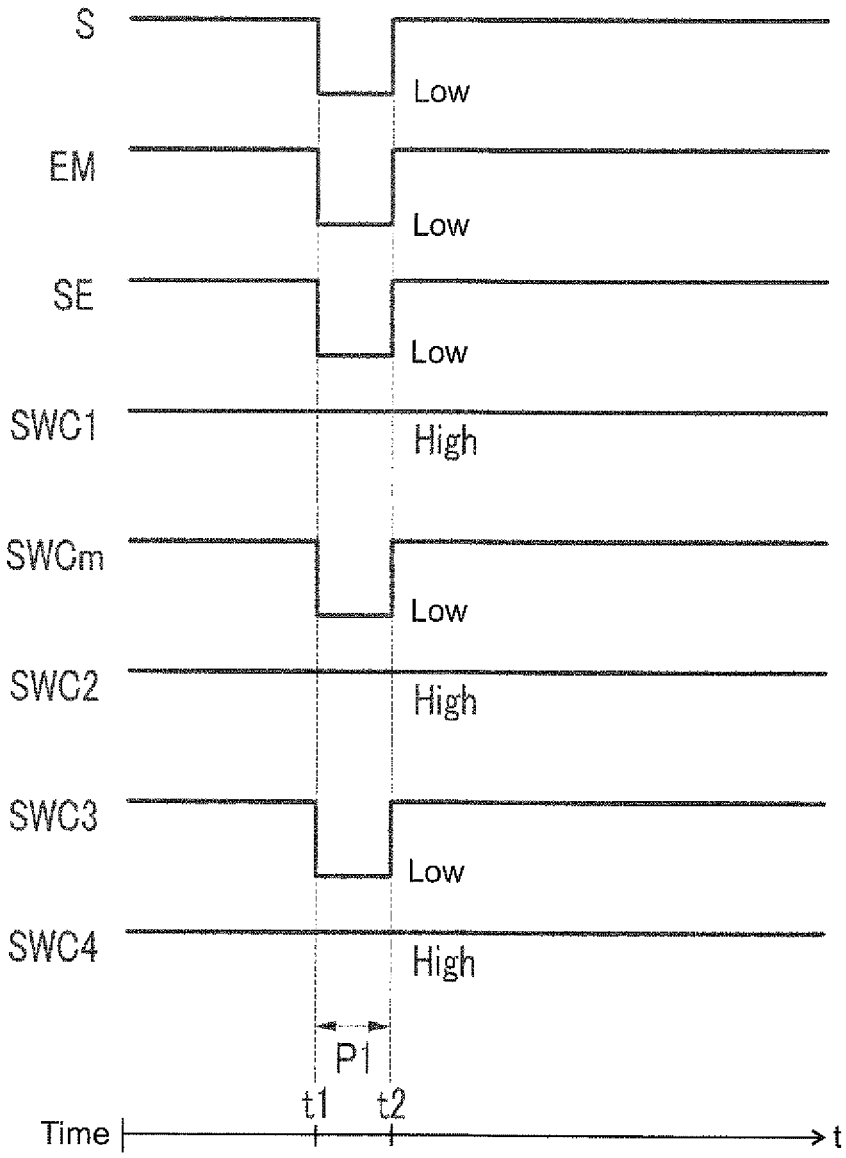
FIG. 5 to FIG. 8 are driving waveforms supplied to a pixel and a selector according to an exemplary embodiment of the present invention.
Figure 6:
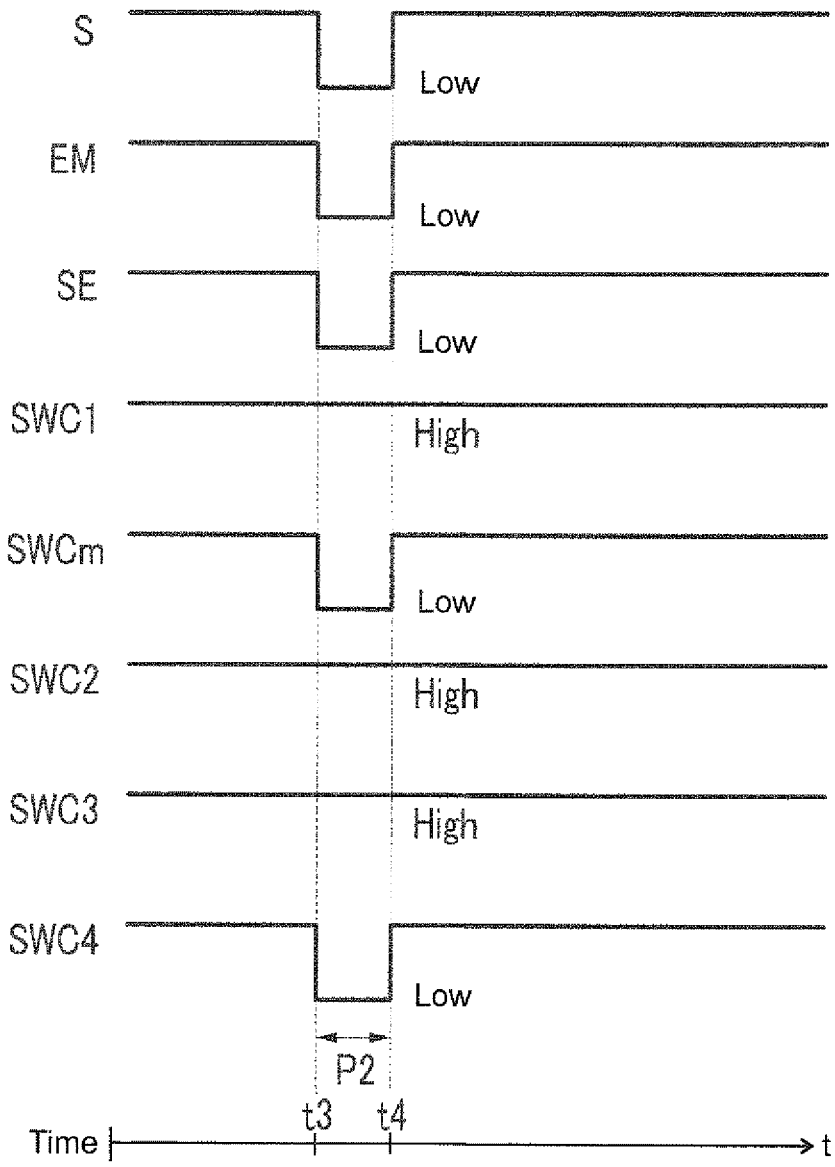
Figure 7:
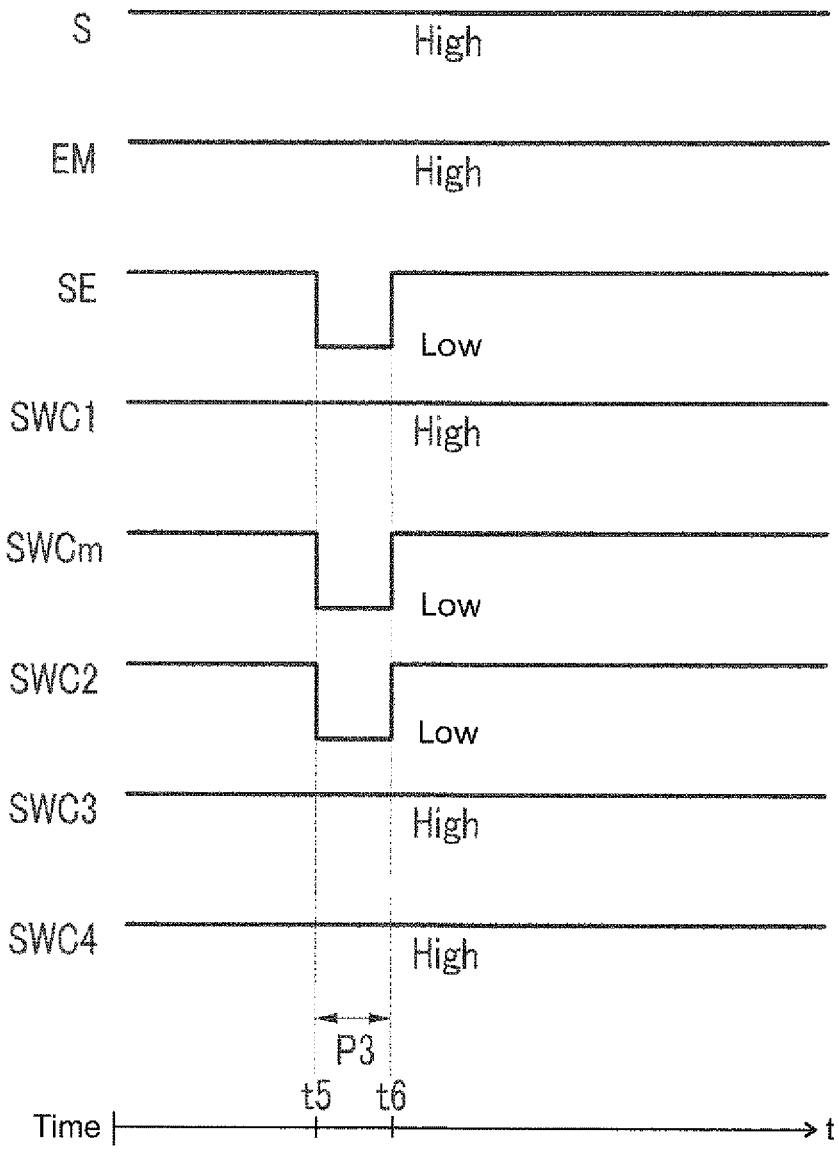
Figure 8:
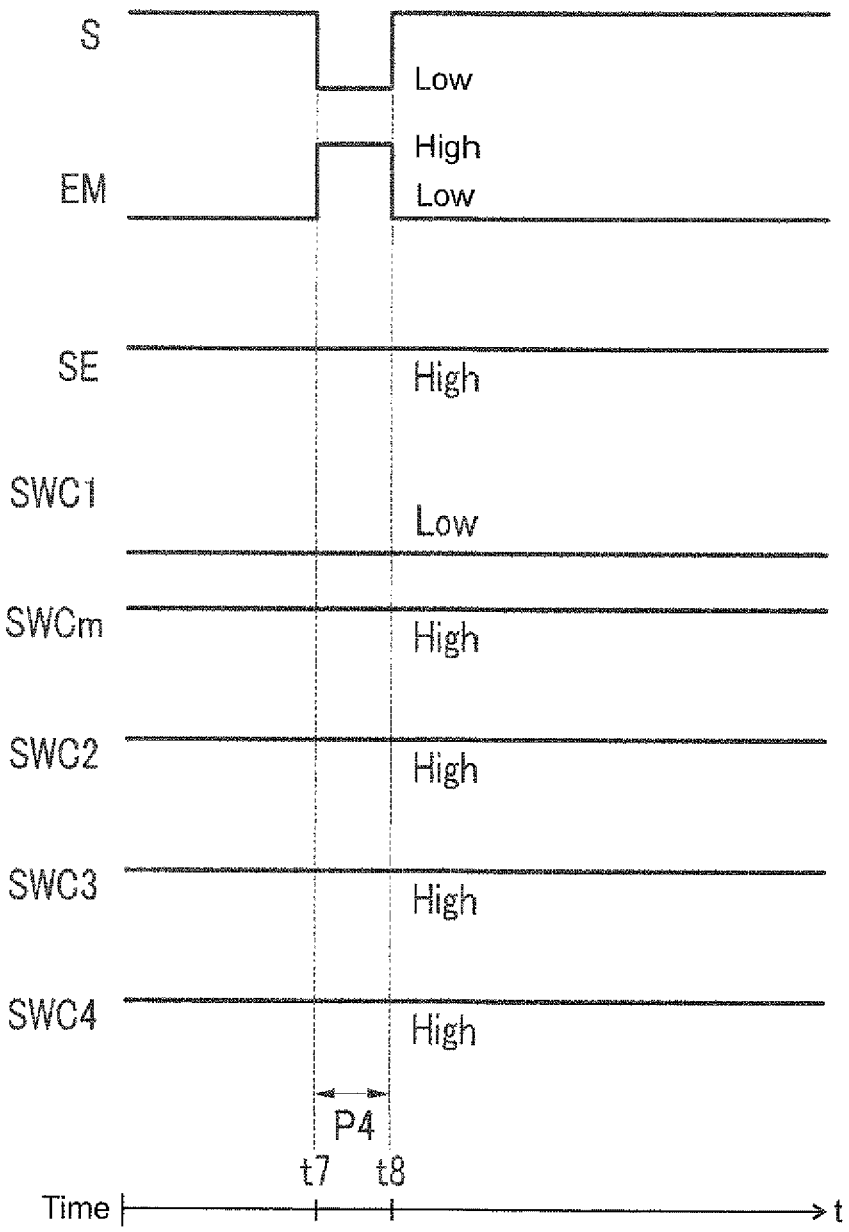
Figure 9:
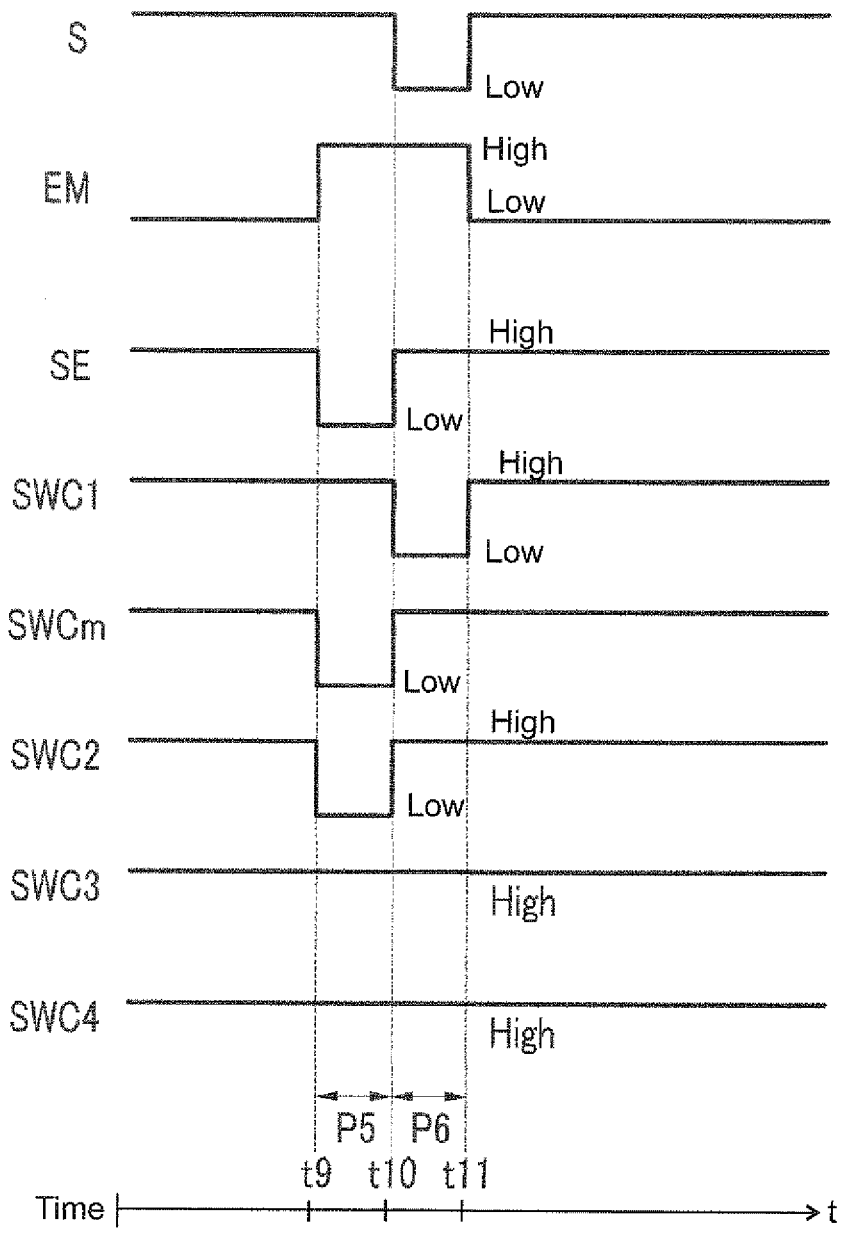
FIG. 9 is a driving waveform supplied to a pixel and a selector according to another exemplary embodiment of the present invention.

FIG. 5 is a waveform diagram for the first current sink 603 to sense the second voltage, FIG. 6 is a waveform diagram for the second current sink 605 to sense the third voltage, FIG. 7 is a waveform diagram for the current source 601 of the compensator 60 to sense the first voltage, FIG. 8 is a waveform diagram for transmitting a data signal and displaying an image at the pixel 100, and FIG. 9 is a driving waveform of an organic light emitting diode (OLED) display according to another exemplary embodiment of the present invention, showing a waveform diagram for transmitting the data signal to the pixel 100 and displaying the image when simultaneously sensing the first voltage.

The waveform diagrams shown in FIG. 5 to FIG. 9 are proposed for the case in which transistors and a plurality of selecting switches for configuring the circuit of the pixel 100 shown in FIG. 4 are PMOS transistors, and when the transistors and a plurality of selecting switches included in the circuit of the pixel 100 are realized with NMOS transistors, the polarity of the waveform diagrams will be reversed.

It will be sufficient when the process for compensating the image sticking and mura phenomenon before the display 10 of the organic light emitting diode (OLED) displays an image in the exemplary embodiment of the present invention, and the respective compensation processes are not restricted to the order of FIG. 5 to FIG. 9. Compensation can be performed at a predetermined time that is automatically determined, and it can be performed at a time established by the user.

A process for the organic light emitting diode (OLED) display shown in FIG. 4 according to an exemplary embodiment of the present invention to sense a voltage at the gate electrode of the driving transistor M1 of the pixel 100 according to the waveform of FIG. 5 will now be described.

Referring to FIG. 5, at the time t1, the data selection signal SWC1 for controlling the data selecting switch SW1 connected to the data line corresponding to the pixel 100 is transmitted as the high level at which the data selecting switch SW1 is turned off. Since the compensator selection signal SWCm is transmitted as the low level at the time t1, the compensator selecting switch SWm connected to the compensation line 73 divided from the data line corresponding to the pixel 100 is turned on.

A scan signal S, a light emission control signal EM, and a sensing signal SE that are supplied to the pixel 100 are transmitted as a low level voltage at the time t1. Accordingly, in the pixel 100 of FIG. 4, the second transistor M2 having received the scan signal S, the third transistor M4 having received the light emission control signal EM, and the first transistor M3 having received the sensing signal SE are turned on at the time t1.

During the period P1 in which the second transistor M2, the third transistor M4, and the first transistor M3 are turned on, the second switch SW3 of the first current sink 603 is turned on by the low-level selection signal SWC3. The second current is sunk through the data line connected through the turned-on compensator selecting switch SWm during this period.

Accordingly, the driving transistor M1 is turned on to form the current path from the first power source voltage ELVDD to the cathode of the organic light emitting diode (OLED). Also, the voltage difference Vgs between the gate electrode of the driving transistor M1 and the first electrode is formed as the voltage value corresponding to the second current, and the voltage (the second voltage) at the gate electrode of the driving transistor M1 is applied to the first node N1.

The second voltage is transmitted to the analog-to-digital converter 607 passing through the data line Dm connected to the pixel 100 through the second transistor M2, and the compensation line 73, and is converted into the digital value.

Referring to FIG. 6, from the time t3 to the time t4, the data selection signal SWC1 for controlling the data selecting switch SW1 is transmitted as high level and the data selecting switch SW1 is turned off. On the contrary, since the compensator selection signal SWCm is transmitted as low level at the time t3, the compensator selecting switch SWm connected to the compensation line 73 divided from the data line corresponding to the pixel 100 is turned on.

At the time t3, the scan signal S, the light emission control signal EM, and the sensing signal SE supplied to the pixel 100 are transmitted as low level voltages to turn on the second transistor M2, the third transistor M4, and the first transistor M3 during the period P2.

Here, the third switch SW4 of the second current sink 605 is turned on in response to the low-level selection signal SWC4. The second current sink 605 sinks the third current through the data line connected through the turned-on compensator selecting switch SWm during the period P2.

Accordingly, the driving transistor M1 is turned on to form the current path from the first power source voltage ELVDD to the cathode of the organic light emitting diode (OLED). Also, the voltage difference Vgs between the gate electrode of the driving transistor M1 and the first electrode is formed as the voltage value corresponding to the third current such and the voltage (the third voltage) at the gate electrode of the driving transistor M1 is applied to the first node N1.

The third voltage is passed through the data line Dm connected to the pixel 100 through the second transistor M2 and the compensation line 73, is transmitted to the analog-to-digital converter 607, and is converted into the digital value.

The memory 609 of the compensator 60 stores digital values of the converted second voltage and the third voltage, and the controller 613 calculates the threshold voltage and the electron mobility of the driving transistor M1 of the pixel 100 from the voltage values.

As an exemplary embodiment, a current value of the second current sunk by the first current sink 603 is set to be the current value Imax when the pixel emits light with the maximum luminance, and a current value of the third current sunk by the second current sink 605 is set to be a current value corresponding to the low grayscale data voltage, and particularly it is set to be the current value ¼ Imax that corresponds to ¼ of Imax.

A voltage value at the gate electrode of the driving transistor M1 applied to the first node N1 of FIG. 4 when the current is sunk with the second current and the third current, that is, the voltage value V1 of the second voltage and the voltage value V2 of the third voltage, are calculated as follows.

$$V1 = ELVDD - \sqrt{\frac{2I\max}{\beta}} - |VthM1| \quad \text{Equation 1}$$

$$V2 = ELVDD - \frac{1}{2}\sqrt{\frac{2I\max}{\beta}} - |VthM1| \quad \text{Equation 2}$$

Here, ELVDD of Equations 1 and 2 is the voltage value supplied by the first power source voltage ELVDD and it is the voltage at the first electrode of the driving transistor M1 at node N4.

Also, β is the mobility of the electrons moving in the channel of the driving transistor M1, and |VthM1| is a proper threshold voltage of the driving transistor M1 of the pixel 100.

Hence, the threshold voltage and mobility of the driving transistor M1 in the two equations can be found.

However, when the current is sunk with the third current that is set to be the current value ¼ Imax, it is difficult to realize the low grayscale data. Particularly, since it is difficult to achieve black luminance with a desired level, a predetermined compensation voltage value (Vshift) is applied to the voltage value V2 of the third voltage that is detected when sunk by the third current. The detection time of the third voltage becomes faster and achievement of black luminance of a desired level is enabled since the current is not sunk with the minimum current. When the compensation voltage value (Vshift) is applied, Equation 3 is acquired.

$$\begin{aligned} V3 &= V2 + Vshift \\ &= ELVDD - \frac{1}{2}\sqrt{\frac{2I\max}{\beta}} - |VthM1| + Vshift \end{aligned} \quad \text{Equation 3}$$

Here, the V3 voltage value represents the voltage value applied to the first node N1 when the pixel 100 is sunk with the current value that is given when the pixel 100 emits light with the lowest luminance. When the entire grayscale is 256 grayscale levels, it indicates the voltage value that is detected when the current is sunk with the current value of 1/256 Imax.

Unknown quantities Q1 and Q2 relating to the mobility and threshold voltage of the driving transistor are calculated by using Equations 1 and 3, and the threshold voltage and mobility of the driving transistor M1 included in a plurality of pixels of the display 10 can be calculated.

The unknown quantities Q1 and Q2 are expressed in Equations 4 and 5.

$$Q1 = \sqrt{\frac{2I\max}{\beta}} \quad \text{Equation 4}$$

$$Q2 = |VthM1| = ELVDD - Q1 - V1 \quad \text{Equation 5}$$

The threshold voltage and mobility of the driving transistor M1 for the respective pixels calculated by the controller 613 are stored in the memory 609.

The waveform diagram of FIG. 7 is the waveform diagram of the period in which the driving voltage of the organic light emitting diode (OLED) of the pixel 100 is sensed.

Referring to FIG. 7, during the period P3 from the time t5 to the time t6, the data selection signal SWC1 is transmitted as high level to turn off the data selecting switch SW1, and the compensator selection signal SWCm is low-level, and hence the compensator selecting switch SWm connected to the compensation line 73 divided from the data line corresponding to the pixel 100 is turned on.

During the period P3, the scan signal S and the light emission control signal EM are transmitted as a high level voltage, and the sensing signal SE is transmitted as a low level voltage.

Accordingly, the second transistor M2 having received the scan signal S and the third transistor M4 having received the light emission control signal EM in the pixel 100 are turned off during the period P3, and the first transistor M3 having received the sensing signal SE is turned on during the period P3.

Here, the first switch SW2 of the current source 601 receives the low-level selection signal SWC2, and is turned on in response thereto. The current source 601 supplies the first current to the organic light emitting diode (OLED) through the compensation line 73 and the data line Dm connected through the turned-on compensator selecting switch SWm during period P3.

In the case of a normal organic light emitting diode (OLED), the driving voltage applied to the anode is the appropriate voltage value corresponding to the first current, however resistance of the deteriorated organic light emitting diode (OLED) is increased to relatively increase the driving voltage applied to the anode of the organic light emitting diode (OLED). The increased driving voltage of the organic light emitting diode (OLED) is the first voltage, and the first voltage is transmitted to the analog-to-digital converter 607 passing through the turned-on first transistor M3, the data line Dm, and the compensation line 73, and is converted into a digital value.

The memory 609 stores the digital value of the first voltage, and the controller 613 determines the data signal compensation amount of compensating by the voltage value increased by the deterioration based on the first voltage so that the organic light emitting diode (OLED) may emit light with appropriate luminance according to the data signal.

FIG. 8 is a waveform diagram for the pixel 100 to normally emit light according to the data signal.

From the time t7 to the time t8, the data selection signal SWC1 is low level, and the data selecting switch SW1 connected to the data line corresponding to the pixel 100 is turned on in response thereto. On the contrary, since the compensator selection signal SWCm is transmitted as high level during the period of the time t7 to time t8, the compensator selecting switch SWm connected to the compensation line 73 divided from the data line corresponding to the pixel 100 is turned off.

The low-level scan signal S is supplied to the pixel 100 at the time t7, and the second transistor M2 is turned on during the period P4.

The data driver 30 transmits the compensated data signal to the corresponding data line Dm through the turned-on data selecting switch SW1 during the period P4. The data signal is transmitted to the first node N1 passing through the second transistor M2, and the storage capacitor Cst connected to the first node N1 charges the voltage value corresponding to the data signal.

The data signal transmitted to the pixel 100 is generated from the image data signal corrected by the timing controller 50 of FIG. 4.

The corrected image data signals Data2 are converted into an analog data signal by a digital analog converter 31 of the data driver 30.

The analog data signal can be supplied to the data line Dm connected to the corresponding pixel 100 from among a plurality of pixels through a negative feedback type operational amplifier 33. Since the organic light emitting diode (OLED) of the pixel 100 emits light according to the corrected data signal, image sticking and mura phenomenon are removed from the entire image of the display 10 to provide quality images.

FIG. 9 is a waveform diagram of a process for sensing in real-time the driving voltage of the organic light emitting diode (OLED) when normally driving the display according to another exemplary embodiment of the present invention.

Referring to FIG. 9, since the compensator selection signal SWCm falls to become low level at the time t9 and maintains the low level during the period P5, the compensator selecting switch SWm connected to the compensation line 73 divided from the data line corresponding to the pixel 100 is turned on during the period P5. Since the compensator selection signal SWCm rises to become the high level at the time t10, the compensator selecting switch SWm is turned off during the period P6. On the contrary, the data selection signal SWC1 is transmitted as high level during the period P5 to turn off the data selecting switch SW1, and the data selection signal SWC1 is transmitted as low level during the period P6 to turn on the data selecting switch SW1.

The sensing signal SE supplied to the pixel 100 is a low level voltage at the time t9 and it is supplied during the period P5, turning first transistor M3 on. During the period P5, the first switch SW2 of the current source 601 is turned on in response to the selection signal SWC2.

During the period P5, in a like manner of the method described with reference to FIG. 7, the current source 601 supplies the first current to the organic light emitting diode (OLED) through the data line and the compensation line 73 connected through the turned on compensator selecting switch SWm, and transmits the first voltage to the analog-to-digital converter 607 through the turned on first transistor M3.

The first switch SW2 is turned off in response to the selection signal SWC2 at the time t10, and the data selection signal SWC1 simultaneously falls to become low level to turn on the data selecting switch SW1 during the period P6.

Since the low-level scan signal S is supplied to the pixel 100 at the time t10, the second transistor M2 is turned on during the period P6. The data signal is transmitted to the first node N1 by passing through the second transistor M2 through the corresponding data line Dm in a like manner of the method described with reference to FIG. 8, during the period P6, and the storage capacitor Cst is charged with the voltage value according to the corresponding data signal.

When the scan signal S rises to a high level voltage at the time t11 after the storage capacitor Cst is charged with the voltage corresponding to the data signal, the second transistor M2 is turned off, and the light emission control signal EM falls to the low level voltage to turn on the third transistor M4. Therefore, the driving transistor M1 supplies the driving current corresponding to the data signal to the organic light emitting diode (OLED) to display an image with predetermined luminance.

In the waveform diagram of FIG. 9, the corresponding sensing signal SE is supplied before the scan signal S corresponding to the pixel 100 is supplied to store driving voltage information of the organic light emitting diode (OLED) in the memory 609. During a predetermined one frame period, the driving voltage of the organic light emitting diode (OLED) is sensed and is stored in the memory 609, and the corrected data signal is transmitted to the pixel in the next frame period to emit light.

Figure 10:
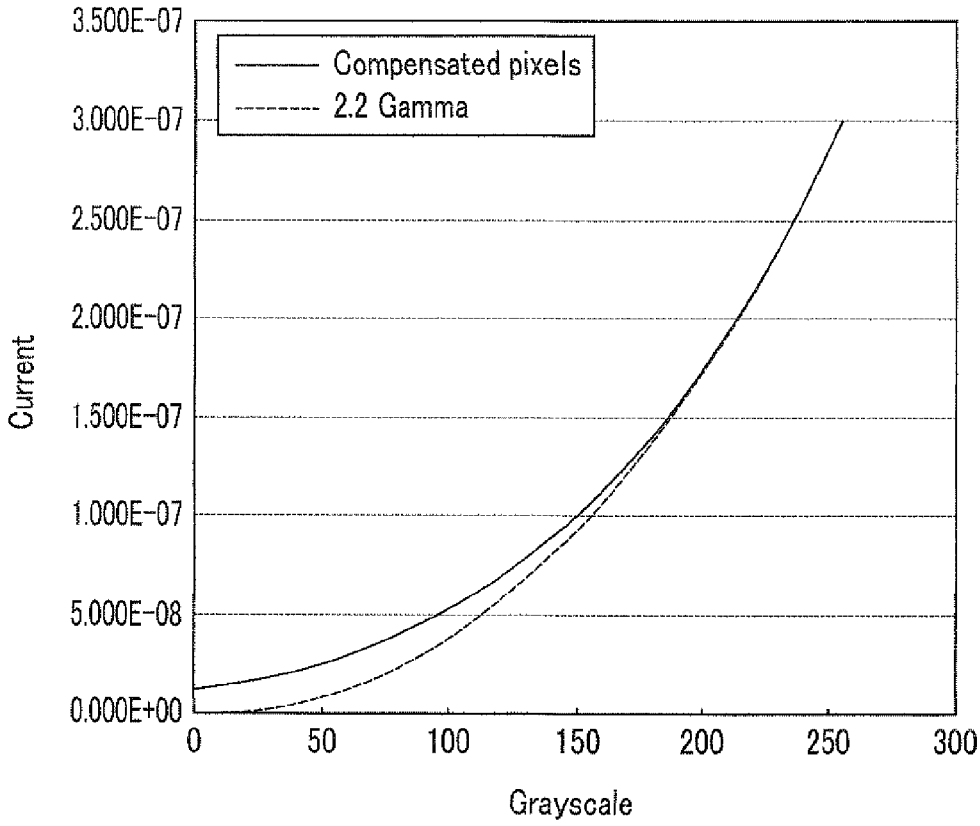
FIG. 10 is a graph of current curves for grayscales in an organic light emitting diode display to which an existing algorithm is applied.

FIG. 10 is a graph of current curves for grayscales of the organic light emitting diode (OLED) display having applied the existing algorithm.

In detail, FIG. 10 shows a graph of current curves for grayscales of the image of which the data signal is corrected by detecting the voltage at the gate electrode of the driving transistor of the pixel following the waveform diagrams of FIG. 5 and FIG. 6, and finding and compensating the threshold voltage and mobility deviation of the driving transistor and by using Equations 1 and 2.

It is found in FIG. 10 that the pixel having emitted light according to the compensated data signal failed to sufficiently realize the low grayscale data area.

Figure 11:
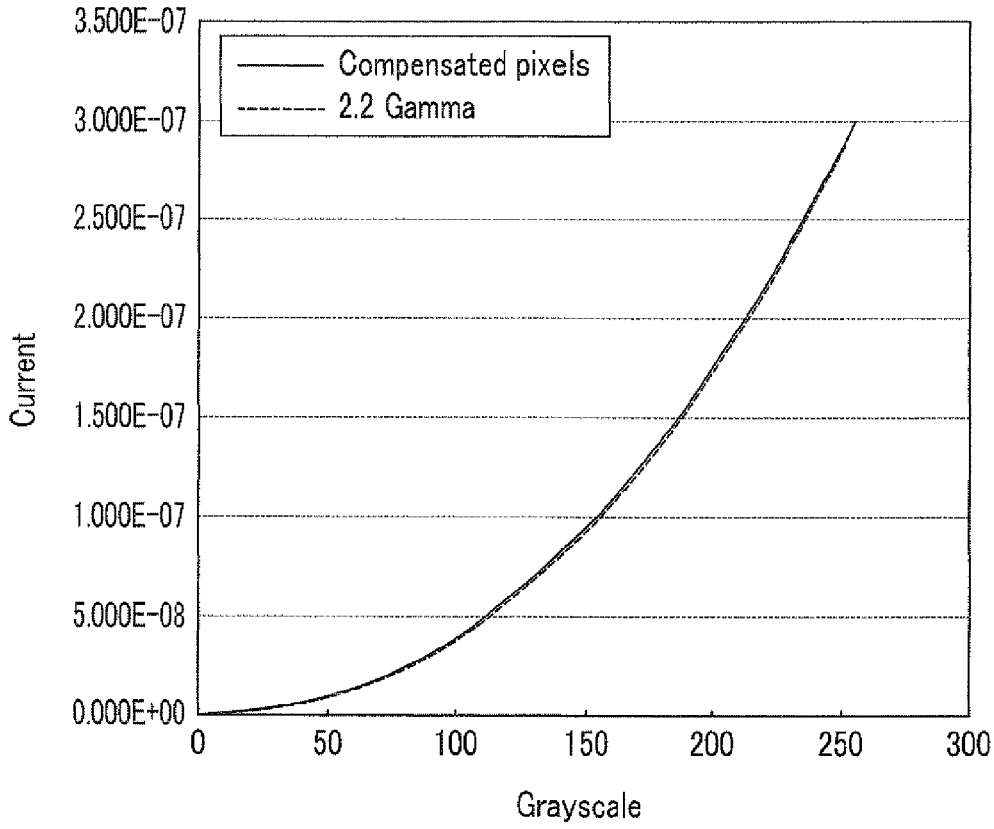
FIG. 11 is a graph of current curves for grayscales in an organic light emitting diode display to which an algorithm according to an exemplary embodiment of the present invention is applied.

However, when the compensation amount is calculated by applying a compensation voltage value (Vshift) for compensating the difference with the voltage value of the gate electrode of the driving transistor of the pixel that is detected by sinking the current with the current value corresponding to the minimum grayscale data voltage, it is found as shown in FIG. 11 that the low grayscale data area is sufficiently expressed in correspondence to the 2.2 gamma curve.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Also, the material of respective constituent elements described in the specification can be easily selected and substituted from various materials by a person of ordinary skill in the art. Furthermore, a person of ordinary skill in the art can omit part of the constituent elements described in the specification without deterioration of performance or can add constituent elements for better performance. In addition, a person of ordinary skill in the art can change the specification depending on the process conditions or equipment. Hence, the range of the present invention is to be determined by the claims and equivalents.

What is claimed is:

1. An organic light emitting diode display having a plurality of pixels, each pixel comprising:

an organic light emitting diode (OLED);

a driving transistor for supplying a driving current to the organic light emitting diode;

a data line for transmitting a corresponding data signal to the driving transistor;

a first transistor having a first electrode connected to one electrode of the organic light emitting diode and a second electrode connected to the data line; and a second transistor having a first electrode connected to the data line and a second electrode connected to a gate electrode of the driving transistor:

wherein the first transistor, the second transistor, and the driving transistor are turned on, a first current and a second current are respectively sunk in a path of a driving current from the driving transistor to the organic light emitting diode through the data line, and wherein a threshold voltage and an electron mobility of the driving transistor are calculated by receiving a first voltage and a second voltage applied to the gate electrode of the driving transistor corresponding to sinking of the first current and the second current through the second transistor and the data line, and the data signal transmitted to the data line is compensated.

2. The organic light emitting diode display of claim 1, wherein the display receives a third voltage applied to one electrode of the organic light emitting diode through the data line while supplying a predetermined third current to the organic light emitting diode by turning on the first transistor, and the display detects a deterioration degree of the organic light emitting diode according to the third voltage, and compensates a data signal transmitted to the data line in order to compensate the detected deterioration.

3. The organic light emitting diode display of claim 2, further comprising:

a compensator for receiving the third voltage through the data line; and a compensator selecting switch provided between the data line and the compensator, and transmitting the third voltage to the compensator when turned on by a corresponding selection signal.

4. The organic light emitting diode display of claim 3, wherein the compensator comprises a current source for supplying a third current so as to detect the third voltage.

5. The organic light emitting diode display of claim 4, wherein the compensator further comprises a controller for determining a deterioration degree of the organic light emitting diode according to the third voltage, and determining a compensation amount corresponding to a data signal according to the determined deterioration degree.

6. The organic light emitting diode display of claim 1, wherein the second current has a current value that is less than that of the first current.

7. The organic light emitting diode display of claim 6, wherein the first current represents a current value corresponding to a high gray scale data voltage.

8. The organic light emitting diode display of claim 6, wherein the first current represents a current value flowing to the organic light emitting diode when the organic light emitting diode emits light with the maximum luminance.

9. The organic light emitting diode display of claim 6, wherein the second current represents a current value corresponding to the low gray scale data voltage.

10. The organic light emitting diode display of claim 6, wherein the second current represents a current value that is 0.1% to 50% of the first current.

11. The organic light emitting diode display of claim 1, wherein the second voltage is compensated with a compensation voltage value caused by a difference between the second voltage and a voltage value applied to a gate electrode of the driving transistor that is detected by sinking with a current value flowing to the organic light emitting diode when the organic light emitting diode emits light with the minimum luminance.

12. The organic light emitting diode display of claim 1, further comprising:

a compensator for receiving the first voltage and the second voltage through the data line; and a compensator selecting switch provided between the data line and the compensator, and transmitting the first voltage or the second voltage to the compensator when turned on by a corresponding selection signal.

13. The organic light emitting diode display of claim 12, wherein the compensator comprises:

a first current sink for sinking the first current so as to detect the first voltage; and a second current sink for sinking the second current so as to detect the second voltage.

14. The organic light emitting diode display of claim 13, wherein the compensator further comprises a controller for calculating a threshold voltage and an electron mobility of the driving transistor according to the first voltage and the second voltage, and determining a compensation amount corresponding to the data signal according to the calculated threshold voltage and electron mobility of the driving transistor.

15. An organic light emitting diode display, comprising:

a plurality of pixels including a plurality of organic light emitting diodes and a plurality of driving transistors for supplying driving current to the organic light emitting diodes;

a plurality of data lines for transmitting corresponding data signals to the pixels; and a compensator for receiving a plurality of first voltages and a plurality of second voltages that are respectively applied to the respective gate electrodes of the driving transistors through the data lines while respectively sinking the first current and the second current on a path of a driving current from the driving transistor to the organic light emitting diode through the data line;

wherein the compensator calculates a threshold voltages and an electron mobility of the respective driving transistors according to the received first voltages and second voltages, and compensates the data signals that are transmitted to the pixels according to the calculated threshold voltages and electron mobility of the driving transistors.

16. The organic light emitting diode display of claim 15, wherein the compensator receives driving voltages of the organic light emitting diodes through the corresponding data lines while supplying a predetermined third current to the organic light emitting diodes through the data lines, determines deterioration degrees of the organic light emitting diodes according to the received driving voltages, and compensates the data signals that are transmitted to the pixels according to the determined deterioration degrees.

17. The organic light emitting diode display of claim 16, wherein the organic light emitting diode display further comprises a selector including a plurality of data selecting switches connected to the data lines and a plurality of compensator selecting switches connected to a node of a plurality of diverged lines divided from the data lines, and the compensator selecting switches are turned on by the corresponding selection signals to transmit driving voltages of the organic light emitting diodes to the compensator.

18. The organic light emitting diode display of claim 16, wherein the compensator comprises a current source for supplying the predetermined third current to the organic light emitting diodes.

19. The organic light emitting diode display of claim 18, wherein the compensator further comprises a controller for determining deterioration degrees of the organic light emitting diodes according to respective driving voltages of the organic light emitting diodes, and determining a compensation amount of the data signal according to the determined deterioration degree.

20. The organic light emitting diode display of claim 15, wherein the second current has a current value that is less than that of the first current.

21. The organic light emitting diode display of claim 20, wherein the first current represents a current value that corresponds to a high gray scale data voltage.

22. The organic light emitting diode display of claim 20, wherein the first current represents a current value flowing to the organic light emitting diode when the organic light emitting diode emits light with the maximum luminance.

23. The organic light emitting diode display of claim 20, wherein the second current represents a current value that corresponds to a low gray scale data voltage.

24. The organic light emitting diode display of claim 20, wherein the second current has a current value that is 0.1% to 50% of the current value of the first current.

25. The organic light emitting diode display of claim 15, wherein the second voltage is compensated with a compensation voltage value caused by a difference between the second voltage and a voltage value that is applied to the gate electrode of the driving transistor that is detecting by sinking with a current value flowing to the organic light emitting diode when the organic light emitting diode emits light with the minimum luminance.

26. The organic light emitting diode display of claim 15, wherein the compensator comprises:

a first current sink for sinking the first current in order to detect the first voltages; and a second current sink for sinking the second current in order to detect the second voltages.

27. The organic light emitting diode display of claim 26, wherein the compensator further comprises a controller for calculating threshold voltages and electron mobility of the respective driving transistors according to the first voltages and the second voltages, and determining a compensation amount corresponding to the respective data signals that are transmitted to the pixels according to the calculated threshold voltages and electron mobility of the driving transistors.

28. The organic light emitting diode display of claim 15, wherein the organic light emitting diode display further comprises a selector including a plurality of data selecting switches connected to the data lines and a plurality of compensator selecting switches connected to a node of a plurality of diverged lines divided from the data lines, and the compensator selecting switches are turned on by corresponding selection signals to transmit the first voltages and the second voltages to the compensator.

29. A method for driving an organic light emitting diode (OLED) display comprising a plurality of pixels including a plurality of organic light emitting diodes and a plurality of driving transistors for supplying a driving current to organic light emitting diodes, a plurality of data lines for transmitting corresponding data signals to the pixels, and a compensator for receiving a plurality of first voltages and a plurality of second voltages that are applied to respective gate electrodes of the driving transistors through the data line while sinking a first current and a second current on a path of a driving current from the driving transistor to the organic light emitting diode through the data line, the method comprising the steps of:

receiving the first voltages and the second voltages applied to the respective gate electrodes of the driving transistors through the corresponding data line, thereby sensing a voltage;

calculating a threshold voltage and an electron mobility of the respective driving transistors according to the received first voltages and second voltages, thereby performing calculation; and compensating a plurality of data signals transmitted to the pixels according to the calculated threshold voltages and electron mobility of the driving transistors.

30. The method of claim 29, wherein the method for driving the organic light emitting diode display further comprises:

receiving driving voltages of the organic light emitting diodes while the compensator supplies a predetermined third current to the organic light emitting diodes through the data lines, thereby sensing a driving voltage; and determining deterioration degrees of the organic light emitting diodes according to the received driving voltages, and compensating the data signals transmitted to the pixels according to the determined deterioration degree, thereby performing compensation.

31. The method of claim 30, wherein while the sensing of a driving voltage is performed, the predetermined third current is controlled to flow to the organic light emitting diodes included in the pixels, and first transistors of the pixels for transmitting the driving voltage of the organic light emitting diode to the corresponding data line are turned on.

32. The method of claim 29, wherein while the sensing of a voltage is performed, first transistors of the pixels connected between one electrodes of the organic light emitting diodes and the corresponding data lines, driving transistors of the pixels for supplying driving current to the organic light emitting diodes, and second transistors of the pixels connected between the corresponding data line and a gate electrode of the driving transistor are turned on.

33. The method of claim 29, wherein the second current has a current value that is less than the first current.

34. The method of claim 33, wherein the first current represents a current value that corresponds to a high gray scale data voltage.

35. The method of claim 33, wherein the first current represents a current value flowing to the organic light emitting diode when the organic light emitting diode emits light with the maximum luminance.

36. The method of claim 33, wherein the second current represents a current value that corresponds to a low gray scale data voltage.

37. The method of claim 33, wherein the second current has a current value that is 0.1% to 50% of the current value of the first current.

38. The method of claim 29, further comprising the step of, before the calculation, compensating the second voltage with a voltage value applied to a gate electrode of the driving transistor detected when sinking with a current value corresponding to a difference of a current value shifted in a low gray scale data voltage.

39. The method of claim 29, further comprising the step of, before the calculation, compensating the second voltage with a compensation voltage value caused by a difference between the second voltage and a voltage value applied to a gate electrode of a driving transistor detected by sinking with a current value flowing to the organic light emitting diode when the organic light emitting diode emits light with the minimum luminance.

* * * * *